US007278863B1

(12) United States Patent
Chen et al.

(10) Patent No.: US 7,278,863 B1
(45) Date of Patent: Oct. 9, 2007

(54) RECEPTACLE CONNECTOR

(75) Inventors: Chung-Yu Chen, Tu-Cheng (TW); Yun-Chien Lee, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/410,922

(22) Filed: Apr. 26, 2006

(51) Int. Cl.
*H01R 12/80* (2006.01)

(52) U.S. Cl. ..... 439/79; 439/668

(58) Field of Classification Search ..... 439/79, 439/668, 63, 581, 947, 83
See application file for complete search history.

(56) References Cited

U.S. PATENT DOCUMENTS

| | | | | |
|---|---|---|---|---|
| 5,007,851 | A * | 4/1991 | Matsumoto | 439/188 |
| 5,797,768 | A * | 8/1998 | Francaviglia | 439/567 |
| 5,927,999 | A * | 7/1999 | Shimojyo | 439/63 |
| 6,322,397 | B1 * | 11/2001 | Zhang | 439/668 |
| 6,382,999 | B1 * | 5/2002 | Mou et al. | 439/188 |
| 6,457,998 | B1 * | 10/2002 | Zhang et al. | 439/660 |
| 6,551,115 | B1 * | 4/2003 | Li et al. | 439/79 |
| 6,994,564 | B1 * | 2/2006 | Kan | 439/63 |
| 7,063,573 | B2 * | 6/2006 | Chen | 439/677 |
| 7,101,230 | B2 * | 9/2006 | Ma | 439/668 |
| 7,108,514 | B2 * | 9/2006 | Chen et al. | 439/63 |
| 7,114,989 | B2 * | 10/2006 | Yin | 439/578 |
| 2003/0045173 | A1 * | 3/2003 | Zhang et al. | 439/668 |
| 2003/0119368 | A1 * | 6/2003 | Li et al. | 439/668 |
| 2005/0048847 | A1 * | 3/2005 | Hsieh | 439/668 |
| 2005/0233603 | A1 * | 10/2005 | Chen et al. | 439/63 |
| 2006/0160427 | A1 * | 7/2006 | Yin | 439/668 |
| 2006/0234563 | A1 * | 10/2006 | Yang | 439/668 |
| 2006/0246116 | A1 * | 11/2006 | Putz | 424/442 |

* cited by examiner

*Primary Examiner*—Ross Gushi
(74) *Attorney, Agent, or Firm*—Rosenberg, Klein & Lee

(57) ABSTRACT

A receptacle connector includes a housing having a first sidewall and a second sidewall. An inserting hole is defined in a middle position of the first sidewall. A first slot and a second slot are defined in the second sidewall. A first conductive terminal has a first contact arm. The first conductive terminal inserts into the housing along the first slot. The first contact arm extends to the inserting hole. The second conductive terminal has a second contact arm. The second fixing arm and a second bending arm connect the second contact arm to the second fixing arm. The second conductive terminal inserts into the housing along the second slot. The second conductive terminal inserts into the housing along the second slot.

6 Claims, 4 Drawing Sheets

RECEPTACLE CONNECTOR

BACKGROUND OF THE INVENTION

1. Field of the Invention

The invention relates to a receptacle connector, and more particularly to a receptacle connectors that has a couple of bending portions used to firmly combine with the housing for charging the batteries of portable electronic devices.

2. The Related Art

Many portable electrical devices such as mobile telephones, personal organizers, media players, cameras, camcorders and portable computers have a receptacle connector for mating with a direct current jack (DC Jack) to electrically communicate with each other.

CN patent number 01279470.8 issued on Dec. 4, 2002 discloses a receptacle connector 100 (as shown in the FIG. 5 and FIG. 6). The receptacle connector 100 has a housing 110. A first conductive terminal 120 and a second conductive terminal 130 are located in the housing 110. The housing 110 has a sidewall 111. The sidewall 111 has a first slot 112 and a second slot 113 therein. The housing 110 has an inserting hole (not shown) to receive the DC Jack. The first slot 112 and the second slot 113 get through the inserting hole. The top end of the first conductive terminal 120 has a first contact arm 121. The bottom end of the first conductive terminal 120 bends outward and forms a fixing arm 122. The top end of the second conductive terminal 130 has a second fixing arm 131 similar to a cylinder pole. The bottom end of the second conductive terminal 130 bends downward and forms a bending arm 132. The first contact arm 121 is inserted into the housing 10 along the first slot 112. The second fixing arm 131 is inserted into the housing 10 along the second slot 113. When the DC Jack is inserted into the receptacle connector 100, the DC Jack electrically connects with the receptacle connector 100 through the first contact arm 121 and the second fixing arm 131.

In such receptacle connector 100, the contact area between the conductive terminal 120, 130 and the housing 110 is limited. Therefore, the conductive terminal 120, 130 can easily be moved when the DC Jack is frequently reinserted into the receptacle connector 100.

SUMMARY OF THE INVENTION

An object of the present invention is to provide a receptacle connector having a first conductive terminal and a second conductive terminal. Each conductive terminal has a bending portion. The structure mechanism of bending portion enlarges the contact area of the surface between the conductive terminal and the housing, therefore, the conductive terminal can firmly combine with the housing.

In order to fulfill the above object, A receptacle connector includes a housing having a first sidewall and a second sidewall. An inserting hole is defined in the middle position of the first sidewall. A first slot and a second slot are defined in the second sidewall. A first conductive terminal has a first contact arm. A first fixing arm and a first bending arm connect the first contact portion to the first fixing arm. The first conductive terminal is inserted into the housing along the first slot. The first contact arm extends to the inserting hole. The second conductive terminal has a second contact arm, a second fixing arm, and a second bending arm connected with the second contact arm and the second fixing arm, the second conductive terminal is inserted into the housing along the second slot. The first bending arm extends perpendicularly downward and has a 90 degree inwardly bend with a first bending portion formed in the end thereof, the second conductive terminal is inserted into the housing along the second slot, the second bending arm extends perpendicularly downward and has a 90 degree inwardly bend with a second bending portion formed in the end thereof.

When a DC Jack is inserted into the receptacle connector, the bending portion firmly combines with the housing in order to prevent the conductive terminal from tilting, so the electrically contact between the DC Jack and the receptacle connector is stable.

BRIEF DESCRIPTION OF THE DRAWINGS

The present invention will be apparent to those skilled in the art by reading the following description of embodiments thereof, with reference to the attached drawings, in which.

DETAILED DESCRIPTION OF THE PREFERRED EMBODIMENTS

Figure 1:
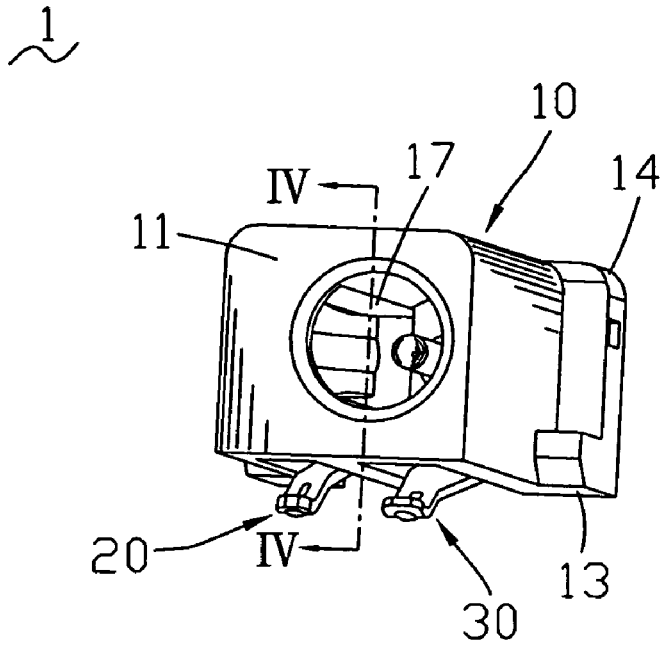
FIG. 1 is a perspective view of a receptacle connector according to the present invention.

For facilitating understanding, like components are designated by like reference numerals throughout the various embodiments of the invention as shown in the attached drawings.

Figure 2:
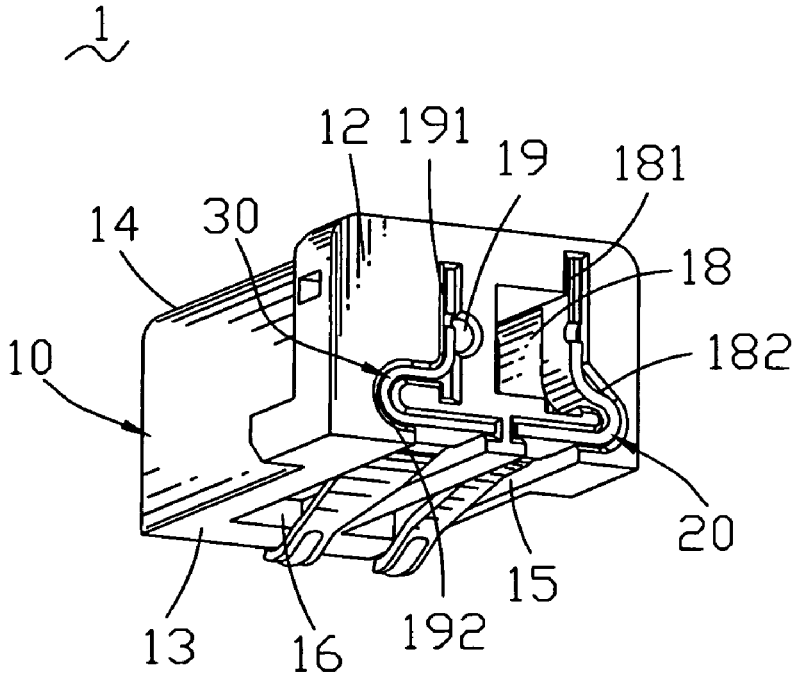
FIG. 2 is a perspective view from the back of the receptacle connector according to the present invention.

With reference to FIG. 1 and FIG. 2, a receptacle connector 1 of the present invention is shown. The receptacle connector 1 has a housing 10, a first conductive terminal 20 and a second conductive terminal 30. The first conductive terminal 20 and a second conductive terminal 30 are inserted into the housing 10, respectively.

Figure 3:
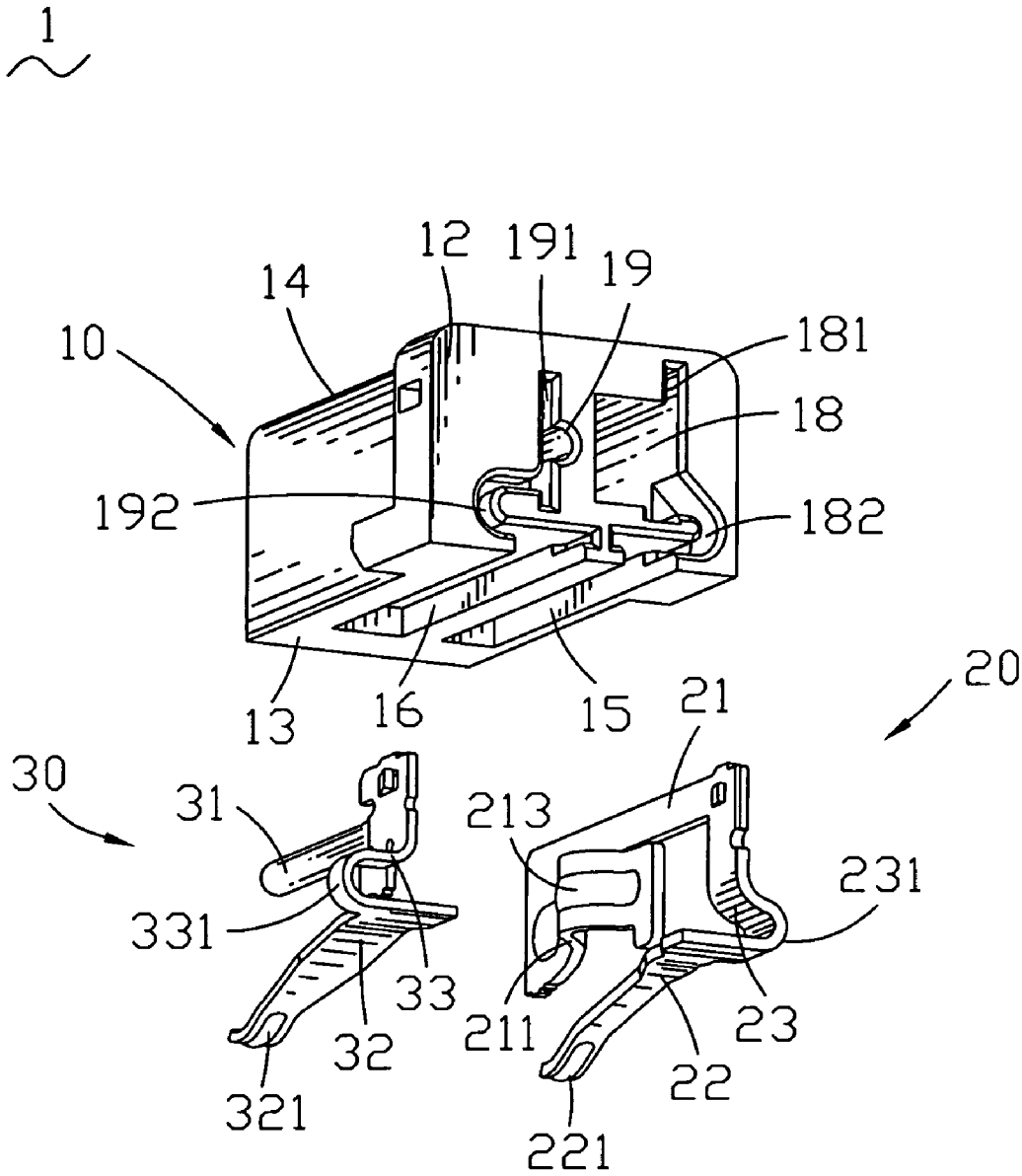
FIG. 3 is a perspective exploded view of the receptacle connector.
Figure 4:
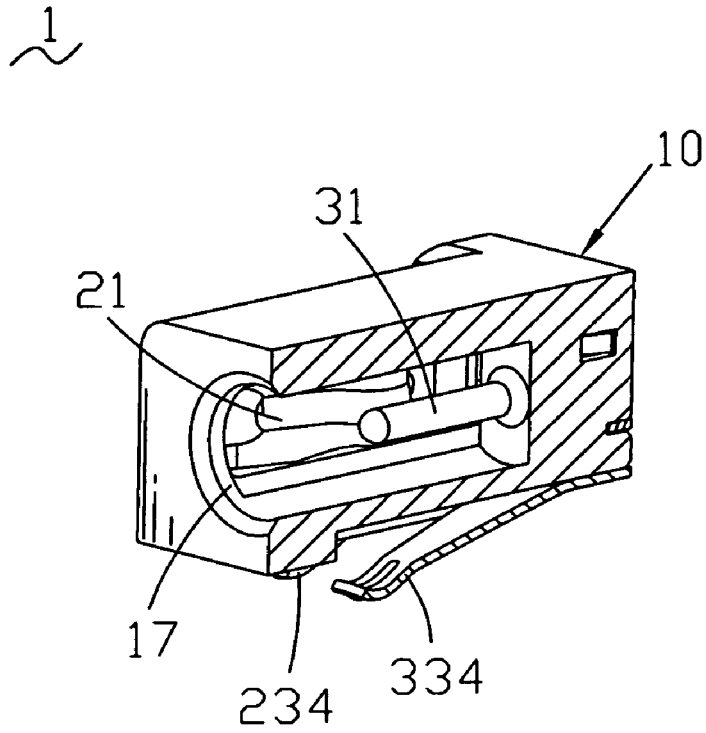
FIG. 4 is a cross-sectional view taken along line IV-IV in FIG. 1.
Figure 5:
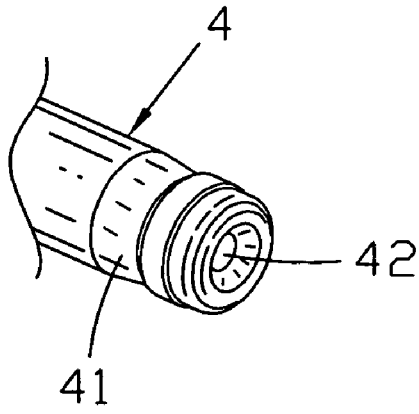
FIG. 5 (Prior Art)
FIG. 5 is a perspective view of a Direct Current Jack according to a prior art.
Figure 6:
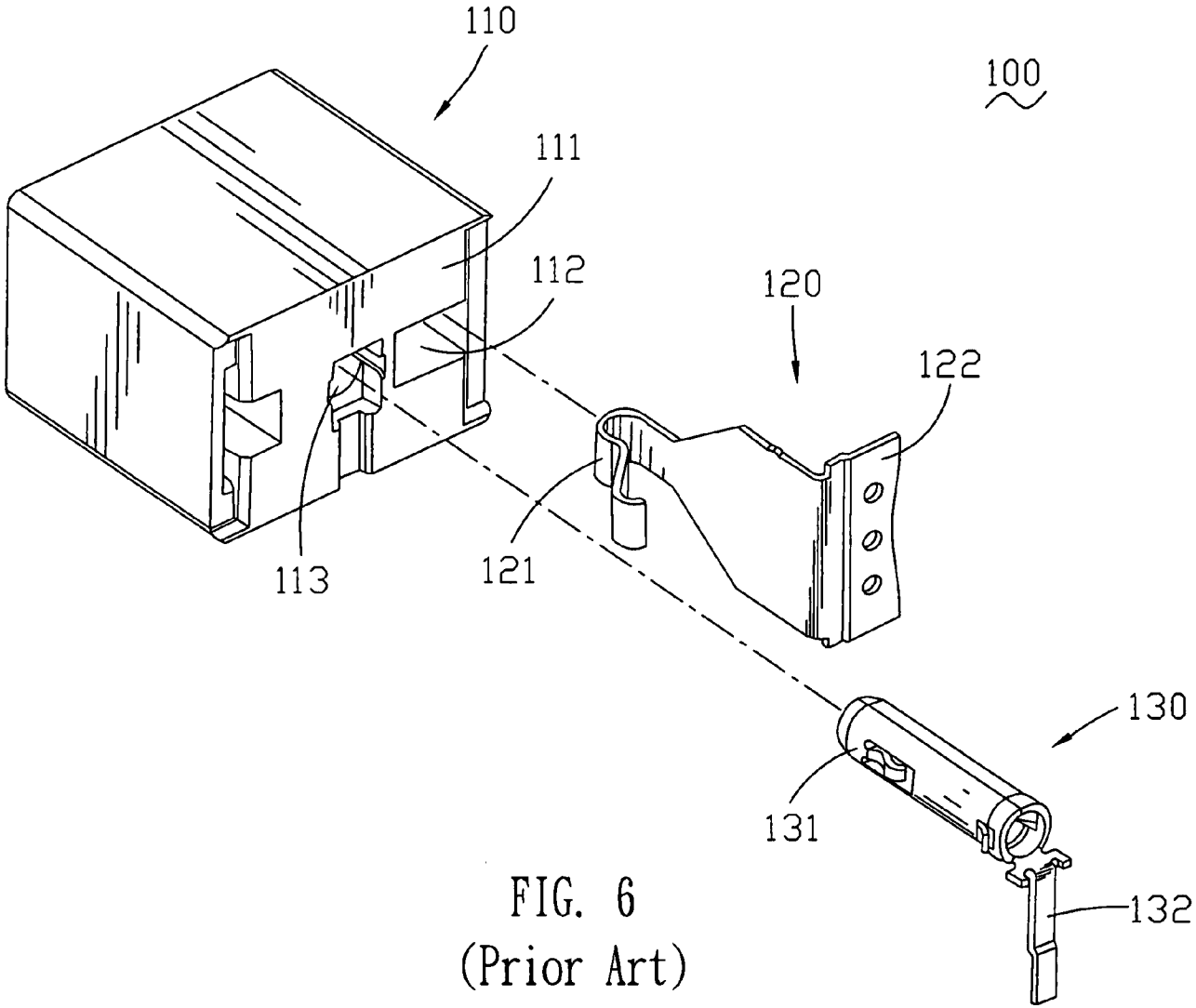
FIG. 6 (Prior Art)
FIG. 6 shows a prior known receptacle connector.

Referring to the FIG. 3, the housing 10 has a first sidewall 11, a second sidewall 12, a third sidewall 13 and a fourth sidewall 14. An inserting hole 17 used for mating with a direct current jack 4 (DC Jack, shown in FIG. 5) is defined in the middle position of the first sidewall 11 and extends backward to the housing 10. A first slot 18 and a second slot 19 are defined in the second sidewall 12. The first slot 18 has a first channel 181, and a first recess 182 of U-shaped. The first channel 181 of the first slot 18 extends forward to the inserting hole 17. The second slot 19 has a second channel 191 and a second recess 192 of U-shaped. The third sidewall 13 has a first groove 15 and a second groove 16 both of rectangular-shaped. The first groove 15 and the second groove 16 are defined in parallel.

The first conductive terminal 20 and the second conductive terminal 30 are located in the receptacle connector 1 of the present invention and have a double contact structure, respectively. The first conductive terminal 20 has a first contact arm 21, a first fixing arm 22 and a first bending arm 23. The first contact arm 21 extends to the inserting hole 17. One side of the first contact arm 21 has a spring contact plate 211. A contact portion 213 extends forwardly from the spring contact plate 211. An opposite side of the first contact arm 21 extends backward to the first bending arm 23 and vertically contacts the top end of the first bending arm 23.

The first bending arm 23 extends perpendicularly downward and has a 90 degree inwardly bend with a first bending portion 231 formed in the end thereof. The first bending portion 231 is a U-shaped structure being rotated at a 90 degree angle as shown in FIG. 3. The first fixing arm 22 extends forwardly from one end of the first bending portion 231 and is aligned with the first contact arm 21. A first fixing portion 221 is defined in the free end of the first fixing arm 22.

The second conductive terminal 30 has a second contact arm 31, a second fixing arm 32, and a second bending arm 33 connected with the second contact arm 31 and the second fixing arm 32. The second contact arm 31 is similar to a rigid pin. The second bending arm 33 extends perpendicularly downward and has a 90 degree inwardly bend with a second bending portion 331 formed in the end thereof. The second bending portion 331 is also a U-shaped structure being rotated at a 90 degree angle as shown in FIG. 3. The second fixing arm 32 extends forwardly from one end of the second bending portion 331 and is aligned with the second contact arm 31. A second fixing portion 321 is defined in the front of the first fixing arm 32.

With reference to FIG. 2 and FIG. 3, the following paragraphs will describe an assembling of the receptacle connector 1 in detail.

The first conductive terminal 20 is inserted into the housing 10 along the first slot 18. The first contact arm 21 and the first spring contact plate 211 are inserted into the first channel 181. The first bending portion 231 is mated with the first recess 182. The first fixing arm 22 is received in the first groove 15. Meanwhile, the first fixing portion 221 extends out of the first groove 15 in order to electrically connect with the printed circuit board (not shown). The second conductive terminal 30 is inserted into the housing 10 along the second slot 19. The second contact arm 31 is inserted into the second channel 191. The second bending portion 331 is mated with the second recess 192. The second fixing arm 32 is received in the second groove 16. Meanwhile, the second fixing portion 321 extends out of the second groove 16 in order to electrically connect with the printed circuit board (not shown).

With reference to FIG. 1, FIG. 2, FIG. 4, and FIG. 5. A DC Jack 4 coupled to the receptacle connector 1 has a cylinder 41 and a contact hole 42. When the DC Jack 4 is inserted into the receptacle connector 1, the cylinder 41 will electrically contact the first contact portion 213 of the first conductive terminal 20, and the contact hole 42 will electrically conduct the second contact arm 31 of the second conductive terminal 30.

As described hereinafter, the first bending portion 231 and the second bending portion 331 enlarge the contact area of the surface between the conductive terminal 20, 30 and the housing 10. Therefore, the conductive terminal 20, 30 can firmly combine with the housing 10. Furthermore, the U-shaped structure prevents the conductive terminal from tilting when the DC Jack is inserted into the housing 10. In this case, the electrically contact between the DC Jack 4 and the receptacle connector 1 is stable.

While the present invention has been described with reference to special embodiments, therefore the description is illustration and is not to be constructed as limiting the invention, Various modifications to the present invention may be made to the preferred embodiments by those skilled in art without departing from the true spirit or scope of the invention as defined by the appended claim.

What is claimed is:

1. A receptacle connector comprising:

a housing having a first sidewall and a second sidewall, an inserting hole being defined in a middle position of the first sidewall, the second sidewall having a first slot and a second slot;

a first conductive terminal having a first contact arm, a first fixing arm and a first bending arm, the first conductive terminal inserted into the housing along the first slot; and a second conductive terminal having a second contact arm, a second fixing arm and a second bending arm and the second conductive terminal inserted into the housing along the second slot;

wherein the first bending arm extends perpendicularly downward and has a 90 degree inwardly bend with a first bending portion formed in the end thereof, the second conductive terminal inserted into the housing along the second slot, the second bending arm extending perpendicularly downward and having a 90 degree inwardly bend with a second bending portion formed in the end thereof wherein the first bending portion is a U-shaped structure being rotated at a 90 degree angle.

2. The receptacle connector as claimed in claim 1, wherein the first slot further comprises a first recess of U-shaped for mating with the first bending portion.

3. The receptacle connector as claimed in claim 1, wherein one side of the first contact arm further comprises a spring contact plate, a contact portion extending forwardly from the spring contact plate, an opposite side of the first contact arm extending backward to the first bending arm.

4. The receptacle connector as claimed in claim 1, wherein the housing further comprises a third sidewall having a first groove and a second groove in parallel and both of rectangular shape, further the first fixing arm and the second fixing arm received in the first groove and the second groove, respectively.

5. The receptacle connector as claimed in claim 1, wherein the second bending portion is a U-shaped structure being rotated at a 90 degree angle.

6. The receptacle connector as claimed in claim 5, wherein the second slot further comprises a second recess of U-shaped for mating with the second bending portion.

* * * * *